United States Patent [19]

Lawrence

[11] 4,099,911

[45] Jul. 11, 1978

[54] AMMONIA PROCESSING OF FABRICS-EFFECTIVE REMOVAL OF RESIDUAL AMMONIA

[75] Inventor: Jackson Lawrence, West Sand Lake, N.Y.

[73] Assignee: Cluett, Peabody & Co., Inc., New York, N.Y.

[21] Appl. No.: 695,471

[22] Filed: Jun. 14, 1976

[51] Int. Cl.[2] ..... D06M 1/02; D06M 1/00

[52] U.S. Cl. ..... 8/125; 8/85 A; 8/116 R; 8/149.1; 8/149.2; 68/5 C

[58] Field of Search ..... 8/125, 116 H, 116 HA, 8/116 V, 85 A, 149.1, 116 R, 35 A

[56] References Cited

U.S. PATENT DOCUMENTS

| | | | |
|---|---|---|---|
| 3,406,006 | 10/1968 | Lindberg | 8/125 |
| 3,915,632 | 10/1975 | Troope | 8/125 |
| 3,942,948 | 3/1976 | Dalle | 8/125 |
| 3,980,429 | 9/1976 | Lawrence et al. | 8/125 |

*Primary Examiner*—A. Lionel Clingman

[57] ABSTRACT

The disclosure relates to equipment and techniques for the removal from fabrics of excess residual ammonia, remaining in the fabric after liquid ammonia processing. The process involves contacting the opposed surfaces of the fabric with a thin film of water, followed by removal of the water from the fabric. The amount of water which contacts the fabric is insufficient to wet the fabric, so that it does not require a subsequent drying step, but is sufficient to release most of the residual ammonia, causing the ammonia to be extracted from the fabric. To advantage, the thin film of water is achieved by condensation of steam on chilled rollers.

8 Claims, 1 Drawing Figure

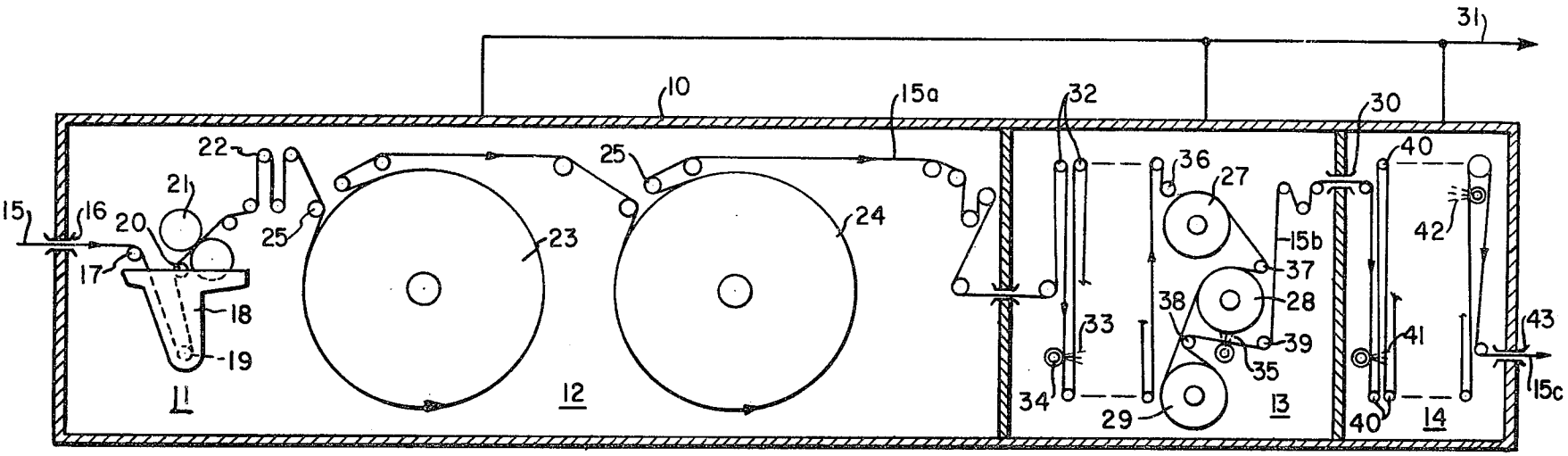
31
43
15c
42
14
40
41
40
30
15b
37
28
39
13
35
27
36
38
29
32
33
34
15a
24
10
25
12
23
25
22
18
19
21
11
20
16
17
15

AMMONIA PROCESSING OF FABRICS-EFFECTIVE REMOVAL OF RESIDUAL AMMONIA

BACKGROUND AND SUMMARY OF THE INVENTION

Techniques have been recently developed for the processing of cellulosic-based fabrics using substantially anhydrous liquid ammonia as a processing liquid. One of the important early developments in this connection is reflected in the Lindberg et al U.S. Pat. No. 3,406,006. Important improvements on the basic Lindberg et al process are reflected in the Walter S. Troope et al United States Application Ser. No. 577,613, filed May 14, 1975, now U.S. Pat. No. 3,980,429. In the liquid ammonia process, as described in the Lindberg et al and Troope et al patents, a relatively dry fabric, having a substantial content of cellulosic fiber, is immersed in or otherwise impregnated with substantially anhydrous liquid ammonia, typically at a temperature of around −33° C. Within a few seconds after impregnation, the liquid ammonia is driven out of the fabric with heat, in order to terminate the operative reactions between the cellulosic fiber and the ammonia. To advantage, this is accomplished by means such as a so-called Palmer dryer, with one or more drying stages as may be appropriate.

Experience has indicated that only about 93–95% of the ammonia content of the fabric after impregnation is removable through the use of dry heat, at least within a time frame appropriate to a continuous commercial process. The residual ammonia is weakly bonded to the cellulosic material of the fabric. Because of the extremely high affinity of water to the cellulose, the more weakly bonded residual ammonia may be removed by contacting of the fabric by water. However, a water spray or water dip operation would require a drying step, and would be both costly and impractical. Heretofore, efforts have been made, with partial success, to remove residual ammonia by subjecting the fabric to the action of high pressure jets of steam. However, exposing the fabric to steam jets is not entirely effective, because the steam in itself is of a "dry" character. In this respect, if the steam used for this purpose is not superheated, it will condense upon the equipment, causing staining and other problems.

In practice, utilizing a combination of dry heat from the Palmer stage, and steam purging and holding time in a subsequent processing chamber, it has been practical in a continuous commercial process to reduce the residual ammonia to about 1% by weight of the fabric. While, in time, this residual ammonia content will be released and evaporated, it can present a problem with regard to the working environment of the process operators. Thus, even where substantial ventilation is provided, a residual ammonia content of around 0.1% is a desirable maximum. Ammonia has a very strong characteristic odor, which can be disagreeable to some individuals and is detectable in the air in concentrations of as low as five parts per million.

In accordance with the invention, significant further reductions in residual ammonia content are made possible by effecting a surface contacting of the fabric with a very thin film of water, adequate to achieve a highly effective release of the weakly bonded ammonia while at the same time insufficient to require a subsequent drying stage. Most advantageously, contacting of the fabric by a film of the character described is achieved by passing the fabric through a secondary treatment zone in which, in addition to being exposed to the action of steam jets, the fabric is passed successively over a pair of chill rollers, contacting first one surface of the fabric and then the other. The chill rollers are supplied with a cooling medium such that there is a continual surface condensation formed on the chill rollers, by condensation of the dry steam atmosphere which prevails in the chamber. It has been found that this light film of moisture, brought into contact with opposite surfaces of the fabric, effectively releases the weakly bonded ammonia from the fabric. Thereafter, the fabric can be passed over a heated roller, which serves to drive the moisture into the fabric. Eventually this moisture is evaporated, together with the combined ammonia before the fabric emerges from the processing chamber. By condensing the steam onto the chill rollers, a precise control over the moisture film is possible, enabling the fabric to be surface moistened without becoming fully wetted.

After surface contacting of the fabric with a water film and subsequent passing of the fabric over a heated roller, the fabric may again be exposed to one or more dry steam purging operations in yet another processing zone. This removes some of the moisture imparted by the chill rolls and along with it most of the residual ammonia, which is displaced by the moisture because of the greater affinity of the water for the fabric than of the ammonia for the fabric. The fabric ultimately discharged from the processing chamber has an extremely low residual ammonia content suitable in most instances to satisfy the environmental requirements and other considerations.

For a better understanding of the above and other features and advantages of the invention, reference should be made to the following detailed description of a preferred embodiment and to the accompanying drawing.

DESCRIPTION OF THE DRAWING

The single FIGURE of the drawing is a highly simplified and schematic representation of a fabric processing installation for carrying out the continuous treatment of cellulosic-based fabrics by anhydrous liquid ammonia, incorporating improvements according to the invention for reduction of residual ammonia content of the discharged fabric.

DESCRIPTION OF A PREFERRED EMBODIMENT OF THE INVENTION

Referring now to the drawing, the reference numeral 10 designates generally a treatment chamber for the continuous treatment of cellulosic-based fabrics by substantially anhydrous liquid ammonia. In general, the chamber 10 comprises four processing zones, including an impregnating and reaction zone 11, a heating or drying zone 12, a moisture application zone 13 and a final purge zone 14. As described in the beforementioned patent and application, and particularly in the Walter S. Troope et al application Ser. No. 577,613, a substantially dry fabric web 15 enters the treatment chamber 10 through a substantially sealed entrance opening 16. The fabric is then guided over an idler roll 17 and down into a trough 18 containing a body of substantially anhydrous liquid ammonia. In the trough, the fabric passes around a lower idler roll 19 and an upper idler roll 20, and then through a pair of squeeze rolls 21. After discharge from the exit side of the squeeze rolls 21, the fabric 15 passes over a series of path length control rollers 22, and is then directed into the heating and drying zone of the treatment chamber.

As described in the Walter S. Troope et al U.S. Pat. No. 3,915,632, the path length control rollers 22 may be adjusted automatically, in accordance with the tension in the fabric at any moment, to vary the transient length of fabric between the ammonia trough 18 and the heating zone 12. As explained in the last mentioned patent, this is a uniquely advantageous arrangement for precisely controlling the length of time during which the fabric is being reacted upon by the liquid ammonia.

In the heating zone 12, there are provided one or more Palmer-type dryers. These include large diameter, heated drums 23, 24 with associated sets of guide rollers 25 arranged to guide the fabric around a substantial part of the circumference of the drums. The Palmer dryers typically include web-confining blankets (not shown), which press the fabric tightly against the outer surfaces of the drums, in a manner well known to those skilled in the art.

When the ammonia-impregnated fabric contacts the hot surface of the first drum 23, the low temperature liquid ammonia is quickly flashed off of the fabric, such that the operative reactions between the ammonia and the cellulosic content of the fabric web are quickly terminated. However, although the ammonia-fiber reactions are effectively terminated, almost instantly after initial contact of the fabric with the first Palmer drum 23, a substantial quantity of ammonia remains present in the fabric, some of it weakly bonded to the cellulosic fibers and other portions of it simply physically present in the vicinity of the fibers. During the continued travel of the fabric around most of the circumference of the first Palmer drum, and then again around most of the circumference of the second drum 24, most of the remaining content of free ammonia is vaporized and driven out of the fabric. Nevertheless, the fabric **15*a* continuing on from the discharge side of the second Palmer drum 24** typically contains a rather substantial quantity of residual ammonia, which may amount to, for example, 2-8% of the weight of the fabric.

In accordance with the invention, highly effective removal of this remaining, residual ammonia fraction is achieved by directing the fabric through a moisture application zone 13, in which the moisture content of the fabric is effectively increased. Since the water has a greater affinity for the cellulosic fiber than does the ammonia, the presence of moisture in the fabric will enable the ammonia to be released from the fibers, after which the ammonia may be driven off by evaporation of the weak solution.

Although the replacement of residual ammonia by water on fabrics has been well known, the development of an effective procedure for bringing the necessary water into contact with the fabric containing the residual ammonia, without at the same time introducing counterproductive complications, has been elusive. For example, simply passing the fabric through a water bath would be highly effective in removing the ammonia. However, this would require drying of the fabric, which is not only costly and time consuming, but in many cases would undesirably affect the character of the liquid ammonia treatment. The application of steam to the fabric has been attempted, but unless the steam is superheated, and relatively "dry" in nature, the resulting condensation of steam on the mechanical equipment creates serious problems, such as marking and staining of the fabric. The use of superheated steam, on the other hand, makes it extremely difficult to impart adequate moisture contents to the fabric to free-up sufficient quantities of the weakly bonded ammonia.

Pursuant to the invention, the ammonia-treated and dried fabric web **15*a* is directed into the moisture application zone 13, where it is passed in surface contact with a pair of moisture application rolls 27, 28, arranged to contact opposite surfaces of the fabric 15*a* in sequence. Provisions are made for providing on the surfaces of the applicator rolls 27, 28, a very thin film of water, which is applied by contact to the opposite surfaces of the fabric. The amount of moisture thus applied to the fabric is insufficient to wet the fabric completely through. However, after passing the second moisture application roll 28, the fabric is directed onto and around a substantial part of the circumference of a heated roll 29**. This serves to vaporize some of the surface moisture and drive it into the fabric, as a wet vapor or wet steam, so that the fabric is thoroughly impregnated with moisture, without at the same time becoming wet.

After leaving the heated roller 29, the moisturized fabric **15*b* advantageously is directed through an opening 30, into the final purge chamber 14. In the purge chamber, the fabric is exposed to the direct action of dry steam jets, an is directed through an elongated path within the zone, so as to increase the dwell period of the fabric in that zone. While in the purge zone 14, the ammonia-containing moisture is driven off through the fabric, enabling the finished fabric 15*c*** to be discharged with an extremely low residual ammonia content.

Each of the zones 12, 13, 14 is vented, as at 31, so that the spent process gases can be withdrawn and removed for recovery processing. An advantageous procedure for such recovery processing is described and claimed in the copending application of Jackson Lawrence Ser. No. 679,059, filed Apr. 21, 1976.

In the process of the invention, the fabric **15*a*, upon first entering the moisturizing chamber 13, is passed about a series of vertically spaced guide rollers 32, providing a preliminary dwell of the fabric in the moisturizing zone. Shortly after entering the zone, the fabric is exposed to a jet 33 of dry steam, ejected from a suitable pipe 34 and desirably arranged to pass directly through the fabric. An additional such jet of steam 35 may be directed through the fabric after it passes around the heated roll 29, and additional jets may be provided if desired. In any event, the atmosphere within the moisturizing zone 13** is made up primarily of dry steam issued from the several jets.

The moisture applicator rolls 27, 28 are exposed to the steam atmosphere within the zone 13 and are supplied internally with a cooling medium, typically water, at a temperature such as to achieve a surface temperature of the rolls 27, 28 of, say, 50° C. The arrangement is such that moisture from the steam-laden atmosphere within the zone 13 is caused to condense in a thin "film" on the surfaces of the rolls 27, 28.

As reflected in the drawing, a pair of fabric guide rollers 36, 37 is associated with the first moisture applicator roll 27, arranged to guide the fabric around a limited arc of, say, 60° or so of the circumference of the rollers. Likewise, the guide roller 37 and the heated roll 29 are so arranged, with respect to the second moisture applicator roll 28, as to cause the fabric to be guided about a similarly limited portion of the circumference of the roll 28. The remaining portions of the surfaces of the moisture applicator rolls 27, 28 are exposed directly to the atmosphere of the zone 13, as is clearly indicated in the drawing. Thus, as the fabric traverses the zone, and the rolls 27, 28 rotate in synchronism therewith, a substantial portion of the surface of each roller is exposed to the steam atmosphere and, by reason of the flow through these rolls of the cooling medium, is able to continuously condense moisture onto the roller surfaces, building up a very thin film of water by the time the roller surface engages the fabric.

The water "film" which is condensed on the surfaces of the applicator rolls 27, 28 need not be an uninterrupted layer, but may be a series of closely spaced condensed droplets which, when absorbed on the fabric surface, will be fully distributed over the fabric surface area.

During the brief interval in which the rolls 27, 28 are in contact with the fabric surface, the thin film of moisture on the roller surfaces is applied to the surface of the fabric, it being understood that the quantities of moisture thus applied, while sufficient for the purposes of the invention, are insufficient to thoroughly wet the fabric, such that it has to be dried.

After applying moisture to both surfaces of the fabric, the fabric is directed around a large part of the periphery of the heated roll 29. This roll is supplied internally with a heating medium, such as steam, sufficient to maintain the surface temperature of the roll at about 140° C. This tends to vaporize the surface moisture on the fabric, causing it to thoroughly penetrate the fabric and effect the release of the residual ammonia still retained by the interior of the fabric.

After leaving the heated roll 29, the fabric passes around guide rollers 38, 39, and as it travels between those rollers is acted upon by the jet 35 of superheated steam, which tends to drive out of the fabric the moisture just applied thereto by the applicator rolls 27, 28. Conveniently, after passing through the fabric, the steam may be directed against the surface of the roll 28, serving in part as the source of condensed moisture thereon.

In the final purging zone 14, the fabric is passed between a large plurality of vertically spaced guide rollers 40, to provide a predetermined dwell time within the zone. While in the zone, the fabric is acted upon by one or more jets 41, 42 of dry steam, serving to further drive off any moisture imparted to the fabric in the moisturizing zone 13. Since the minor quantity of residual ammonia vapor remaining in the fabric has substantially mixed with such moisture, the removal of that moisture from the fabric also results in removal of the ammonia. Thus, the moisturized and purged fabric emerging from the discharge opening 43 is at a desirably low level of residual ammonia, entirely suitable to the requirements of the process.

A significant step in the process is, of course, the so-called kiss coating of the fabric surface by an applicator roll having a very thin film of water thereon. And, while the condensation of dry steam on the chilled surface of the applicator roll is an extremely advantageous technique for controlled formation of a water film of the type desired, it is also contemplated by the invention that such a film might be achieved by other techniques, such as direct application of water to the roll surface in an appropriately controlled manner. Likewise, it is within the contemplated scope of the invention that, where adequate results might be achieved by the kiss coating of only one surface of the fabric, followed by penetration of the fabric by means of the heated roller 29, that one of the moisture applicator rolls 27 or 28, preferably the former, might be eliminated. Likewise, it may be feasible to eliminate from the process the final purging zone 14, at least as a separate zone.

Thus, it should be understood that the forms of the invention herein specifically illustrated and described are intended to be representative only, as certain changes may be made therein without departing from the clear teachings of the disclosure. Reference should be made to the following appended claims in determining the full scope of the invention.

I claim:

1. In a continuous process for treating fabrics having a content of cellulosic fiber, wherein the fabric is first impregnated with substantially anhydrous liquid ammonia and is then heated to terminate the ammonia reactions and to evaporate and drive off from the fabric a substantial portion of the ammonia, an improved method of reducing the residual ammonia content of the treated fabric, which comprises (a) bringing at least one surface of the fabric into momentary contact with a very thin film of water and thereby imparting to said fabric surface a limited moisture content insufficient to wet the fabric completely through, and (b) thereafter heating said fabric sufficiently to cause said moisture to vaporize and penetrate said fabric, whereby to cause said moisture to replace said residual ammonia within said fabric.

2. The process of claim 1, further characterized by (a) forming said very thin film by exposing a chilled roller surface to steam atmosphere whereby to condense steam on the surface of said roller, and (b) guiding the fabric into contact with said chilled roller over a limited angle of contact.

3. The process of claim 1, further characterized by (a) bringing both surfaces of said fabric successively into contact with a very thin film of water, and (b) thereafter heating at least one surface of said fabric sufficiently to cause said moisture to vaporize and penetrate said fabric.

4. The process of claim 1, further characterized by (a) causing said residual ammonia and moisture to be substantially eliminated from the fabric by exposing the fabric to the action of one or more jets of dry steam.

5. A continuous process for removing residual ammonia from fabric having a cellulosic content and treated by impregnation with substantially anhydrous liquid ammonia, which comprises (a) exposing the fabric to dry heat for a time sufficient to drive off at least about 90% of the ammonia, (b) thereafter moistening at least one surface of the fabric with an amount of water insufficient to wet the fabric completely through, (c) thereafter heating the fabric to cause said fabric to be thoroughly penetrated by moisture from said water, and (d) thereafter heating said fabric to substantially eliminate residual ammonia and excess moisture.

6. The process of claim 5, further characterized by (a) carrying out said process within a generally closed process chamber, (b) controllably removing the gaseous atmosphere from around said chamber throughout the steps of claim 5, and (c) thereafter discharging the fabric into a working environment.

7. The process of claim 5, further characterized by (a) said one surface being moistened by continuous roller application thereto of a very thin film of water.

8. The process of claim 7, further characterized by (a) said film of water being formed by condensation on a moving roller surface of superheated steam.

* * * * *